United States Patent [19]

Weiss et al.

[11] Patent Number: 4,795,106

[45] Date of Patent: Jan. 3, 1989

[54] CLAMPING HEAD FOR WINDING CORES

[75] Inventors: Hans Weiss; Hans-Joachim Fissmann; Hans-Albrecht Ruff, all of Heidenheim, Fed. Rep. of Germany

[73] Assignee: J. M. Voith GmbH, Heidenheim, Fed. Rep. of Germany

[21] Appl. No.: 126,478

[22] Filed: Nov. 30, 1987

[30] Foreign Application Priority Data

Dec. 3, 1986 [DE] Fed. Rep. of Germany ..... 3641255

[51] Int. Cl.[4] ..... B65H 75/24; B23B 5/22

[52] U.S. Cl. ..... 242/72 R; 242/68.1; 279/2 R; 269/48.1

[58] Field of Search ..... 242/72, 72.1, 68.1–68.3; 279/2 R; 269/48.1–48.4

[56] References Cited

U.S. PATENT DOCUMENTS

| | | | |
|---|---|---|---|
| 2,075,192 | 3/1937 | George | 242/72 R |
| 2,922,592 | 1/1960 | Kaltenbach | 279/2 R X |
| 3,648,942 | 3/1972 | Lercher et al. | 242/68.3 |
| 3,791,659 | 2/1974 | Hardin | 279/2 R |
| 3,881,666 | 5/1975 | Greenhalgh | 242/72.1 X |
| 4,284,251 | 8/1981 | Castillo | 279/2 R X |
| 4,715,553 | 12/1987 | Hatakeyama et al. | 242/72.1 X |

FOREIGN PATENT DOCUMENTS

| | | |
|---|---|---|
| 3116325 | 4/1982 | Fed. Rep. of Germany . |
| 2815310 | 6/1982 | Fed. Rep. of Germany . |

*Primary Examiner*—Daniel P. Stodola
*Assistant Examiner*—Steven M. duBois
*Attorney, Agent, or Firm*—Albert L. Jeffers; Richard L. Robinson

[57] ABSTRACT

A clamping head is equipped with angular spreading bodies which engage a winding core. Impingement of the winding core end face on a stop moves the spreading bodies longitudinally on a bevel of the clamping head core against spring force, thereby spreading the spreading bodies so as to engage the inside circumference of the winding core. To that end, the clamping head features a sleeve-shaped part which centers the winding core and is provided with longitudinally extending slots for the angular spreading bodies. A shank of each spreading body, extends radially outward, forms at least indirectly the stop for the winding core end face. Longitudinally movable in the slot, the other shank of the spreading body has a projection which protrudes radially inward and interacts with the bevel of the clamping head core so as to cause the shank to move beyond the peripheral surface of the sleeve-shaped part as the projection runs onto the bevel.

The clamping head secures the winding core in both nonpositive and form-fitting fashion in that the spreading body shanks dig into the winding core. It is distinguished by a design from components which are relatively simple to manufacture and of which the spreading bodies exposed to wear can be replaced easily.

5 Claims, 1 Drawing Sheet

CLAMPING HEAD FOR WINDING CORES

Figure 1:
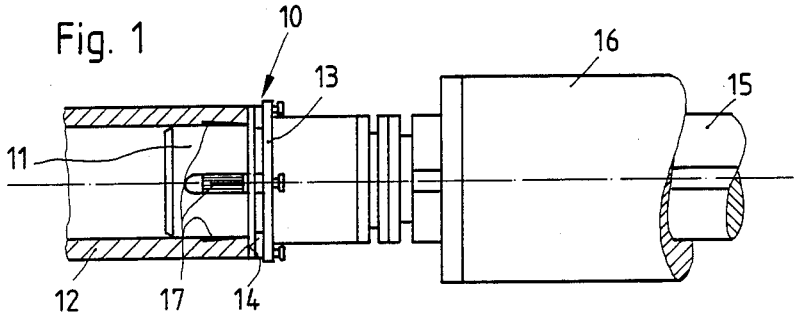

The invention concerns a clamping head for winding cores on which web-type material, such as paper webs and the like, is wound.

A known clamping head is shown in U.S. Pat. No. 3,648,942. It features a sleeve type part which is converted to springy tongues along nearly its entire length by four radial slots of longitudinal extension. This leaves only a very short cylindrical guide which engages the inside circumference of a winding core picked up by the clamping head at the end of the winding core in a centering fashion. Integrally connected with the sleeve-shaped part is a flange, so that in case of wear or fracture of one of the highly stressed tongues the entire component must be replaced. The clamping head is not designed for high stress, since the spring tongues can be circumferentially distorted under the effect of an appropriately large winding torque. Slip between clamping head and winding core is undesirable in the case of winders for paper webs or cardboard webs. However, due to a stop between the flange and the clamping head core which permits play therebetween, the springy tongues can rotate on the clamping head core within limits.

Previously known from the German patent document No. 28 15 310 is a clamping head that features four spreading bodies, each of which extends around nearly one-fourth of the internal circumference of the winding core. These spreading bodies are mounted in longitudinally movable fashion on a core which is fashioned as a truncated pyramid. While this design of the spreading bodies and of the clamping head core promotes the transmission of torques from the clamping head drive to the winding core, the manufacture of the clamping head components is very expensive. But since the winding core is clamped merely nonpositively, slippage of the winding core on the smooth periphery of the spreading bodies cannot be ruled out in winding. To avoid slippage, one of the spreading bodies is additionally equipped with a driver projection which interacts with a recess in the winding core. But the engagement of the driver projection and the recess of the appropriately prepared winding core impedes and retards the clamping operation.

A problem underlying the invention is therefore to provide a clamping head of the initially mentioned category which in addition to a very good centering effect can absorb high support forces and torques without slip. This problem is solved through the features of the present invention.

The solution has the following advantages: Since, due to accommodating the spreading body shanks, the sleeve-shaped part has a correspondingly long design and thus a correspondingly large area of contact with the winding core, the clamping head is able to support large loads. The clamping head enables the nonslip transmission of high torques, since the spreading body shanks engaging the winding core are arranged in the sleeve-shaped part in form-fitting fashion. Connecting the second spreading body shanks with the ring produces a stable spreading body support because the ring safely absorbs the bending moments stemming from the deflection of the first shanks. A further advantage is that, as the clamping head is retracted from the winding core, the spreading bodies are automatically restored to home position in that the projection on the first spreading body shank is pushed under spring effect from the bevel of the clamping head core, allowing this shank to snap back into its recess in the sleeve-shaped clamping head part. Besides, the clamping head is distinguished by a design using components which are relatively simple to manufacture, in which the spreading bodies exposed to wear can be replaced easily.

Previously known from the German patent disclosure No. 31 16 325 is a clamping head with four angular clamping bodies which sit snugly in recesses in the cylindrical clamping head part and its collar. In the absence of a winding core, a longitudinally extending first shank of the clamping body rests in the cylindrical part while its second shank protrudes endwise out of the collar. As the clamping head is slipped (into a winding core, the end face of the latter runs against the second shank and swings the clamping body around, whose first shank juts out of the cylindrical clamping head part and digs into the inside circumference of the winding core. As the end face of the winding core runs on the second shank of the clamping body, an areal contact occurs first which, however, in the further course of the clamping motion transforms into a line contact, due to the swing motion of the clamping body. Since winding cores usually consist of cardboard, a deformation of their end face may occur and consequently result in an incompletely deep digging of the first clamping body shank into the winding core. Besides, the clamping head is not completely safe in operation because an O-ring placed peripherally into the cylindrical part, which serves to restore the clamping bodies in their home position, is particularly susceptible to wear and thus failure.

Additional aspects of the present invention are characterized below. Providing the first shank of a spreading body with longitudinally extending toothing on its side coordinated with the inside circumference of the winding core achieves an especially intensive form fit to safeguard against a turning of the winding core on the clamping head. Furthermore, the design of the spreading body, with the first shank having in the area of its root a cross-sectional reduction while the projection is arranged on the free end of the shank, provides a deflection of the first shank beyond the peripheral surface of the sleeve-shaped clamping head part. This is accomplished in a simple manner in that a force which is directed radially outward on the projection causes in the cross-sectional reduction an elastic deformation of the shank. In the process, the force acts on the shank where it penetrates the deepest into the winding core wall. In addition, a suitable design development for the arrangement of compression springs which exert their force on the spreading bodies involves the clamping head having a collar which is fixed relative to the sleeve-shaped part and in which there are screws disposed parallel with the clamping head axis. Each screw supports a compression spring which bears at one end on the collar and at the other end on the second spreading body shank.

An embodiment of the invention will be more fully explained hereafter with the aid of the drawing.

Figure 2:
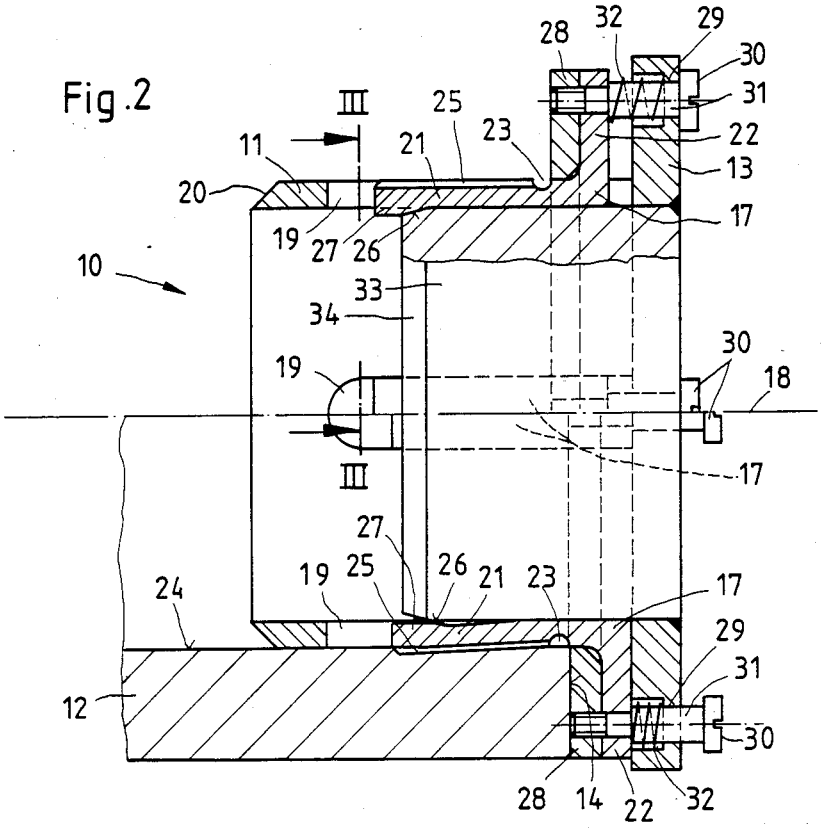
Figure 3:
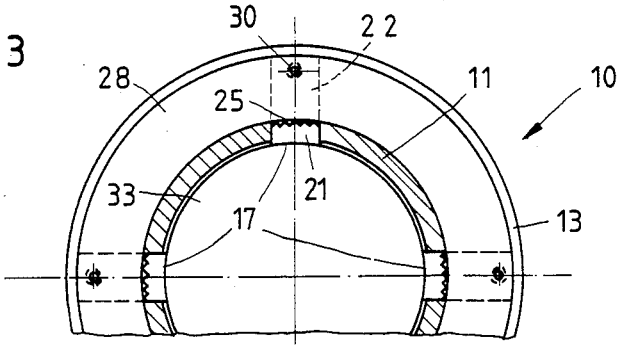

FIG. 1 is a side elevational view of a clamping head which engages a winding core;

FIG. 2, scaled up relative to FIG. 1, shows the clamping head of FIG. 1 mainly in longitudinal section with the spreading bodies in home position in the upper half of the figure, while in the lower half of the figure the spreading bodies engage the winding core; and FIG. 3 is a section of the clamping head along line III—III in FIG. 2, but at a reduced scale, with the spreading bodies in home position.

A clamping head 10 engages with its sleeve-shaped cylindrical part 11 a winding core 12 while with its collar 13 it bears indirectly on a winding core end face 14 (FIG. 1). The clamping head 10 is rotatably mounted on a spindle 15 which extends in longitudinally movable fashion through a spindle guide 16. Such clamping heads 10 are arranged on both ends of the winding core 12, guiding it during winding or unwinding of web type material, such as paper webs or the like. The sleeve-shaped part 11 provides the centering and, indirectly, the collar 13 of each clamping head 10 provides the axial alignment of the winding core 12. Additionally, the clamping head 10 is equipped with spreading bodies 17 which are uniformly distributed around the circumference of the sleeve-shaped part 11 and engage the winding core 12 so as to secure them against sliding on the clamping head and to transmit in the case of a rotationally driven or retarded clamping head a torque to the winding core 12. Design and mode of operation of the spreading bodies 17 will be described hereafter with the aid of FIGS. 2 and 3.

Forming a unit together with the collar 13 extending perpendicularly to the clamping head axis 18, the sleeve-shaped part 11 is provided with four longitudinally extending slots 19 which are uniformly distributed around its circumference (FIG. 2). Slots 19 originate from the collar 13 and end at same width in the marginal zone of the part 11, away from the collar. The part 11 is on its end provided with a bevel 20 so as to facilitate the insertion of the clamping head 10 into the winding core 12. Coordinated with each slot 19 is one of the spreading bodies 17, each featuring two shanks 21 and 22 which extend at right angles to each other. The first shank 21 sits snugly in the slot 19 in the sleeve-shaped part 11 while the second shank 22 is directed radially outward and extends parallel with the collar 13. The first shank 21 of the spreading body 17 has in the area of its root a cross-sectional reduction caused by a groove 23 which extends concentrically with the clamping head axis 18 on the radially outer side of the shank. Originating from this cross-sectional reduction, a longitudinally extending toothing 25 is provided on the side of the first shank 21 which is coordinated with the inside circumference of the winding core 12. Additionally, the shank 21 features on its free end, formed with an inclined face 26, a projection 27 which protrudes radially inward toward the clamping head axis 18.

The second shank 22 of the equally shaped spreading bodies 17 is screwed to a ring 28 which is mounted on the sleeve-shaped part 11 in a fashion such as to be movable coaxially with the clamping head axis 18. For that purpose, the collar 13, which is fixed relative to the sleeve-shaped body 11, is provided with bores 29 in which screws 30 extend parallel with the clamping head axis 18 and are installed lengthwise. Each of the screws 30 supports on its heavier shaft 31 a compression spring 32 which, at one end, bears on the collar 13 and, at the other end, bears on the second shank 22 of the respective spreading body 17 connected with the ring 28.

Snugly fitted in the sleeve-shaped part 11 is an essentially cylindrical clamping head core 33 which is connected with the clamping head, for instance in the area of the collar 13, by welding. On its end section away from the collar, the clamping head core 33 is provided with a conic bevel 34 which is coordinated with the projection 27 of the spreading body shanks 21.

In the absence of a winding core from the clamping head 10, the ring 28 and the shanks 22 of the spreading bodies 17 screwed to it assume under the effect of the compression springs 32 a certain distance from the collar 13 of the clamping head (upper half of FIG. 2). The bevel 26 on the projection 27 of the spreading body shanks 21 rests on the bevel 34 of the clamping head core 33 which is connected with the sleeve-shaped part 11. The toothing 25 on the first shank 21, in this inoperative position of the spreading bodies 17, does not move out of the slot 19 in the sleeve-shaped part 11 (FIG. 3).

As the clamping head 10 is inserted in the winding core 12, the latter slides with its inside circumference 24 over the sleeve-shaped part 11. When running onto the ring 28, the end face 14 of the core causes the ring 28 along with the spreading bodies 17 to move longitudinally toward the collar 13 against the force of the compression springs 32. In the process, the respective projection 27 runs with its bevel 26 onto the bevel 34 of the clamping head core 33, forcing the shank 21 of the spreading body 17, which is installed in longitudinally movable fashion in the respective slot 19, radially outward beginning at its cross-sectional reduction 23. This motion is completed as the shanks 22 of the spreading bodies 17 run onto the collar 13 of the clamping head 10. Moved out beyond the peripheral surface of the sleeve-shaped part 11, the toothing 25 on the spreading body shanks 21 has in this position of engagement of the spreading bodies 17 dug into the winding core 12 from its inside circumference 24 (lower half of FIG. 2).

As the clamping head 10 is retracted from the winding core 12, the compression springs 32 cause the shanks 22 of the spreading bodies 17 to lift off the collar 13 along with the ring 28. The projection 27 on the shank 21 of the spreading bodies 17 is simultaneously shifted along the bevel 34 on the clamping head core 33. The elastically deflected first shank 21 of the spreading bodies 17 springs at the same time radially inward back into the coordinated slot 19 in the sleeve-shaped part 11. At the end of the travel of the spreading body 17, limited by the screws 30, the bevels 26 of the projections 27 on the first spreading body shank rest completely on the bevel 34 of the clamping head core 33, so that the toothing 25 has as well retracted completely into the respective slot 19 of the sleeve-shaped part 11.

What is claimed is:

1. A clamping head for a winding core on which web type material is wound, said winding core having an end face and an inner circumference, said clamping head comprising:

a cylindrical clamping head core having a conic bevel;

a sleeve-shaped part disposed on and fixed relative to said clamping head core and having a peripheral contact surface for engaging and centering said winding core, said sleeve-shaped part having a plurality of longitudinally extending slots distributed circumferentially at least approximately uniformly;

a plurality of spreading bodies, each having a first shank in a respective slot of said sleeve-shaped part and a second shank extending radially outwardly, the first shank having an inwardly protruding projection; and a stop ring disposed on said sleeve-shaped part and arranged coaxially with the clamping head axis and connected to the second shank of each of said plurality of spreading bodies, said stop ring being movable against spring force;

the spreading bodies being movable longitudinally by impingement of the end face of said winding core on said stop ring, the first shanks thereof being spreadable as to move beyond the peripheral contact surface of said sleeve-shaped part and make contact with the inside circumference of said winding core by the run-on action of the inwardly protruding projection of each spreading body onto the conic bevel of said clamping head core.

2. A clamping head according to claim 1, in which the first shank of the spreading body has in an area adjacent the second shank a cross-sectional reduction to increase the bending elasticity of the first shank, the projection being arranged on the free end of the first shank.

3. A clamping head according to claim 1, in which the first shank of the spreading body is provided with a longitudinally extending toothing on the side coordinated with the inside circumference of the winding core.

4. A clamping head according to claim 3, in which the first shank of the spreading body has in an area adjacent the second shank a cross-sectional reduction to increase the bending elasticity of the first shank, the projection being arranged-on the free end of the first shank.

5. A clamping head according to claim 1, in which the clamping head has a collar which is fixed relative to the sleeve-shaped part and in which parallel with the clamping head axis there are screws installed, each of which supports a compression spring which, at one end, bears on the collar and, at the other end, bears on the second shank of a spreading body.

* * * * *